US006913505B1

(12) United States Patent
Chiang

(10) Patent No.: US 6,913,505 B1
(45) Date of Patent: Jul. 5, 2005

(54) SINKABLE FUN TOY

(76) Inventor: Herman Chiang, 11F-2, No. 634-9 Ching-Ping Rd., Chung-Ho City, Taipei Hsien (TW)

( * ) Notice: Subject to any disclaimer, the term of this patent is extended or adjusted under 35 U.S.C. 154(b) by 0 days.

(21) Appl. No.: 10/910,280

(22) Filed: Aug. 4, 2004

(51) Int. Cl.[7] ..... A63H 23/00

(52) U.S. Cl. ..... 446/153; 446/491; 482/55; 273/350; 273/459; 473/466

(58) Field of Search ..... 446/453, 156, 446/161, 71, 92, 124, 491, 153; 472/128; 273/350, 445, 446, 459; 473/466; 482/55, 148

(56) References Cited

U.S. PATENT DOCUMENTS 4,515,572 A * 5/1985 Emms ..... 446/153
4,627,613 A * 12/1986 Solloway ..... 482/111
5,009,413 A * 4/1991 Allen ..... 472/128
5,722,871 A * 3/1998 Zamir ..... 446/153
6,022,024 A * 2/2000 Kahn ..... 273/317
6,332,822 B2 * 12/2001 Greenberg et al. ..... 446/153

* cited by examiner

*Primary Examiner*—Bena B. Miller
(74) *Attorney, Agent, or Firm*—Troxell Law Office, PLLC

(57) ABSTRACT

A sinkable fun toy includes a floater body and a counter weight member. The floater body includes a receiving portion, which has a receiving opening and a stand portion, which has at least one leg for supporting the receiving portion. The counter weight member is received in the receiving opening of the receiving portion. The first and second engaging portions are formed between the receiving portion and the counter weight member and being engaged with each other. After assembled, the floater body and counter weight member being sinkable, sink in water, the receiving portion is kept a desired height from the ground of water by the stand portion. Wherein the first engaging portion and the second engaging portion are disengaged through pressing the counter weight member, the floater body floats on the water but the counter weight member remains in water.

14 Claims, 5 Drawing Sheets

SINKABLE FUN TOY

BACKGROUND OF THE INVENTION

1. Field of the Invention

The present invention relates to a fun toy, and particularly to a sinkable fun toy which is sinkable and floatable; when a player dives into water and presses a specific part of the sinkable fun toy, a part of it will float on the water, so that combines diving sport and amusement.

2. Prior Art

As is well-known, diving sport is able to enhance our vital capacity and is one of the popular aquatic sports in summer. To most people, it would be the greatest enjoyment in summer if combining aquatic sport with amusement. We often see some people play an aquatic game by tossing a coin into water then diving to pick it, as of the first one who picks up the coin as a winner, or some people compete with each other for staying the longer time in water. Such as these games combines diving sport and provides competitive sport.

Furthermore, some aquatic team sports are also combing diving with guessing game. Players are divided into groups. Members of each group listen to the riddle, then dive into the water to pick out the answer, which is prearranged in water. These activities provide both exercises and amusing games.

SUMMARY OF THE INVENTION

Accordingly, an object of the present invention is to provide a sinkable fun toy, which is used for an aquatic game combing the features of diving sport and amusement, and is a much vivid and funny sinkable fun toy.

A feature of the present invention is that the sinkable fun toy includes a floater body and a counter weight member. The floater body includes a receiving portion, which has a receiving opening and a stand portion, which has at least one leg for supporting the receiving portion. The counter weight member is received in the receiving opening of the receiving portion. The first and second engaging portions are formed between the receiving portion and the counter weight member and being engaged with each other. After assembled, the floater body and counter weight member being sinkable, sink in water, and the receiving portion is kept a desired height from the ground of water by the stand portion. When the first engaging portion and the second engaging portion are disengaged through pressing the counter weight member, the floater body floats on the water but the counter weight member remains in water.

DESCRIPTION OF THE PREFERRED EMBODIMENT

Figure 1:
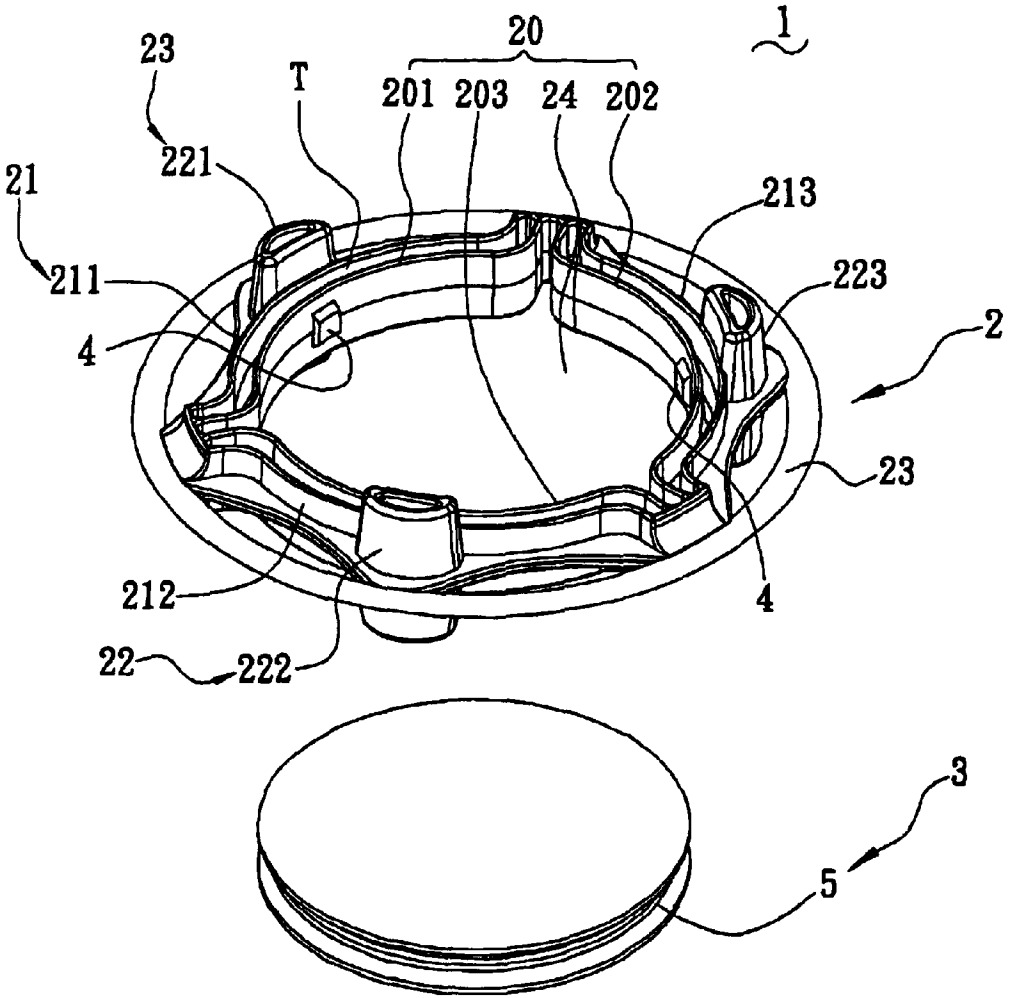
FIG. 1 is an exploded view of a sinkable fun toy of the present invention.
Figure 2:
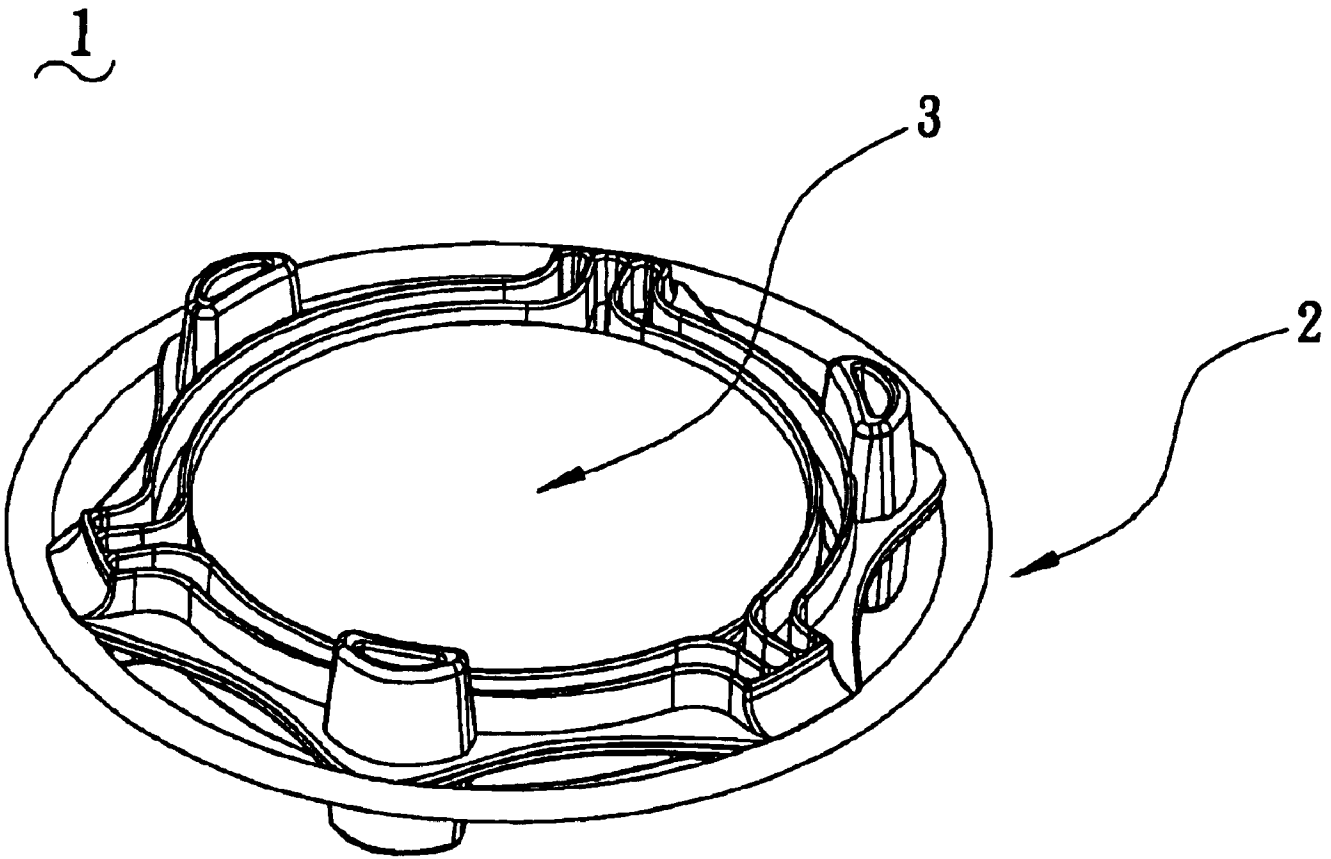
FIG. 2 is an assembled view of FIG. 1.

Referring to FIG. 1, a sinkable fun toy 1 of the present invention includes a floater body 2, a counter weight member 3 and first and second engaging portions 4, 5. The floater body 2 is made from floatable material, such as floatable plastic, stick foam-cotton, a ballonet and so on. The floater body 2 includes a receiving portion 20, a buffering portion 21 and a stand portion 22. The receiving portion 20 includes a first receiving wall 201, a second receiving wall 202 and a third receiving wall 203, thereby defining a receiving opening 24. The receiving opening 24 is large enough to receive a hand and receives the counter weight member 3 therein. The receiving opening 24 may be in one of any symmetrical shapes. In this embodiment, the receiving opening 24 is in a flat cylindrical shape.

The buffering portion 21 includes a first outer wall 211, a second outer wall 212, and a third outer wall 213, correspondingly surrounding the first, second and third receiving walls 201, 202, 203 of the receiving portion 20. Space T is kept between the outer walls 211, 212, 213 and the receiving walls 201, 202, 203 thereby providing resilience to the first, second and third receiving walls 201, 202, 203 in assembly.

The stand portion 22 includes three legs 221, 222, 223, respectively formed at the first, second and third walls 211, 212, 213 of the buffering portion 21 and symmetrically extending from opposite edges of the first, second and third walls 211, 212, 213 with same length. The three legs 221, 222, 223 may be evenly spaced from each other. When the floater body 2 is put underwater, the receiving portion 20 of the floater body 2 keeps a desired height from the bottom of the water through the stand portion 22. The desired height depends on the length of the legs 221, 222, 223 projecting from the receiving portion 20 and should be large enough to disengage the counter weight member 3 from the floater body 2 whereby the floater body 2 floats on the water.

A ring 23 connects the legs 221, 222, 223 and the outer walls 211, 212, 213 together.

The counter weight member 3 is in one of any symmetrical shapes corresponding to the shape of the receiving opening 24. In this embodiment, the counter weight member 3 is in a flat cylindrical shape for being received in the receiving opening 24. The counter weight member 3 may be made from solid hard plastic or hollow hard plastic inside which material with a specific gravity thereof being larger than that of water is filled.

Figure 3:
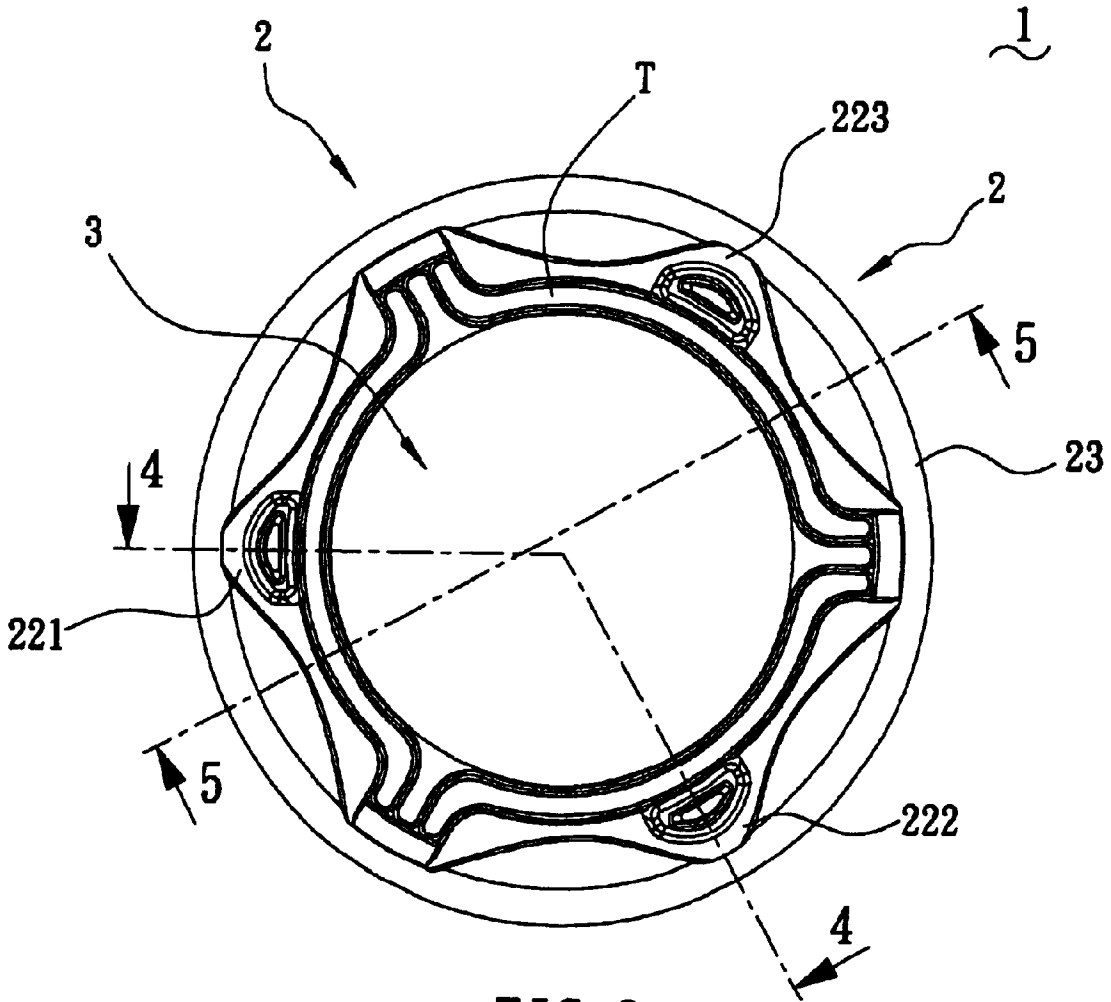
FIG. 3 is a top plan view of FIG. 2.
Figure 4:
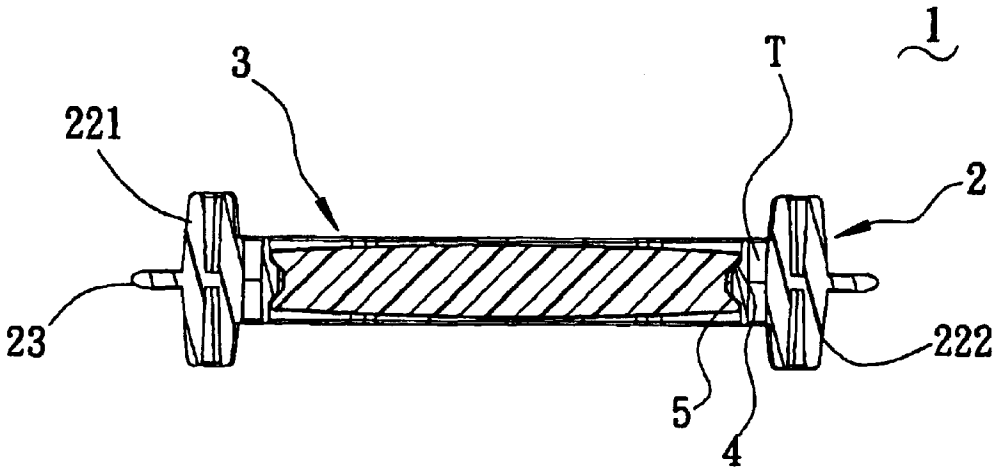
FIG. 4 is a cross-sectional view of FIG. 3 taken along line 4—4 in FIG. 3.
Figure 5:
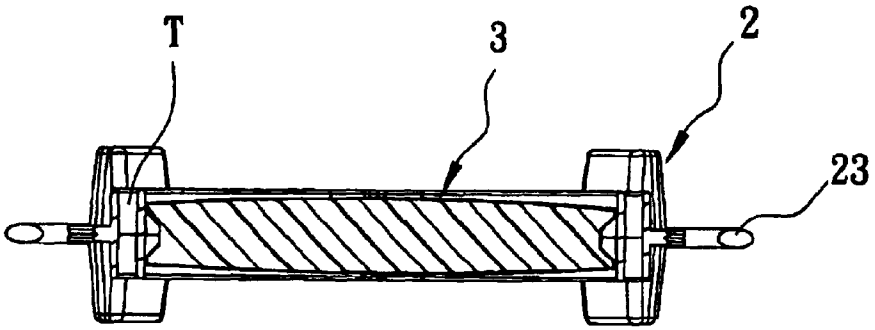
FIG. 5 is a cross-sectional view of FIG. 3 taken along line 5—5 in FIG. 3.

Referring to FIGS. 3–5, the first and second engaging portions 4, 5 are formed between the receiving portion 20 and the counter weight member 3 and engage with each other. The first engaging portion 4 includes three protrusions respectively formed at the first, second and third receiving walls 201, 202, 203 of the receiving portion 20 corresponding to the legs 221, 222, 223 of the stand portion 23. Each protrusion has upper and lower guiding surfaces for guiding the protrusion to engaging with the second engaging portion 5. The second engaging portion 5 includes a recess defined in a peripheral surface of the counter weight member 3. Opposite side surfaces of the recess are arcuate or slanting for facilitating to engage with the protrusions of the first engaging portion 4, whereby the first and second engaging portions 4, 5 are ready to engage or disengage. Furthermore, since the first engaging portion 4 is formed corresponding to the legs 221, 222, 223, when the counter weight member 3 is pressed to disengage from the floater body 2, the legs 221, 222, 223 are supported by the bottom of the water to provide a counterforce to the first engaging portion 4 thereby facilitating to disengage the second engaging portion 5 from the first engaging portion 4.

Further referring to FIGS. 1–5, in assembly, the counter weight member 3 is received in the receiving opening 24 of the floater body 2 and connects to the floater body 2 through the engagement between the first and second engaging portions 4, 5. Thus, the assembled floater body 2 and counter weight member 3 is ready to put underwater and keeps a desired height between the receiving portion 20 and the bottom of the water through the stand portion 23 of the floater body 2.

Figure 6:
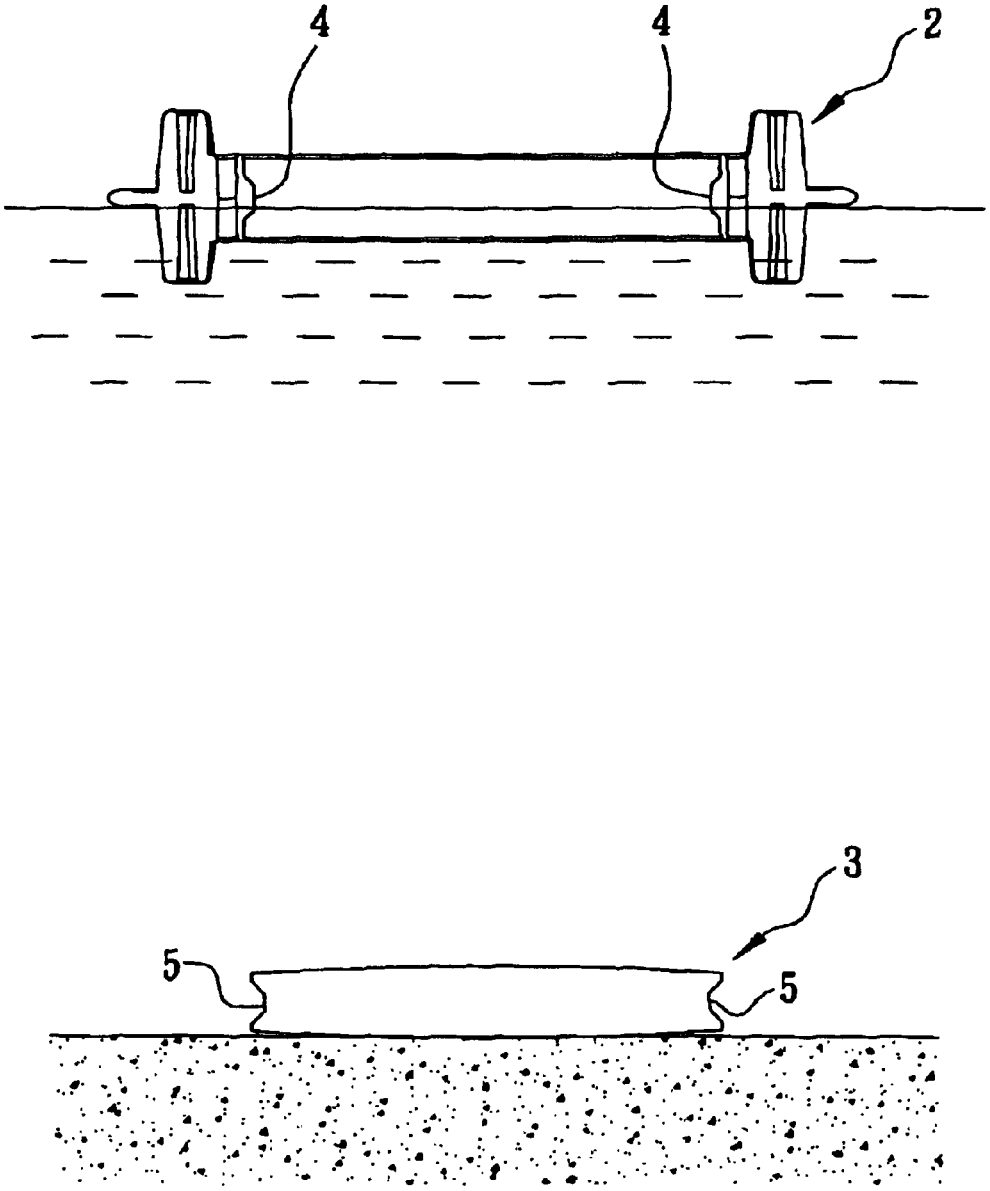
FIG. 6 is a schematic view showing a floater body floating on water after the floater body is disengaged from a counter weight member.

In use, the assembled sinkable fun toy 1 is put underwater. Since the legs 221, 222, 223 of the stand portion 23 symmetrically project from the opposite edges of the first, second and third outer walls 211, 212, 213 with the desired length, the receiving portion 20 of the floater body 2 keeps the desired height from the bottom of the water whichever surface of the receiving portion faces the bottom of the water. Thus, the players may dive into water from a start to look for the sinkable fin toy 1 and the one finding the sinkable fun toy 1 may depress the counter weight member 3 to disengage the second engaging portion 5 from the first engaging portion 4. Thus the floater body 2 floats on the water (see FIG. 6) thereby indicating the one is the winner of the game. Therefore, the sinkable fun toy 1 of the present invention can be used in a diving game and bring fun for the game thereby facilitating diving exercise. 'It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A sinkable fun toy comprising:

a floater body having a receiving portion having a receiving opening with a first engaging portion and a stand portion, the stand portion has at least one leg; and a counterweight member removably inserted into the receiving opening of the receiving portion and having a second engaging portion, the first engaging portion engaging the second engaging portion, wherein, when an assembled floater body and counter weight member is put underwater, the receiving portion of the floater body is located at a predetermined position by the stand portion, and when the first engaging portion and the second engaging portion are disengaged, the floater body floats on the water and the counter weight member sinks.

2. The sinkable fun toy as claimed in claim 1, wherein the receiving portion comprises a first receiving wall, a second receiving wall and a third receiving wall defining the receiving opening.

3. The sinkable fun toy as claimed in claim 2, further comprising a buffering portion surrounding the first, second and third receiving walls of the receiving portion, and includes a first outer wall, a second outer wall and a third outer wall spaced a predetermined distance from the first, second, and third receiving walls.

4. The sinkable fun toy as claimed in claim 3, wherein the opening is a symmetrical shape.

5. The sinkable fun toy as claimed in claim 4, wherein the at least one leg of the stand portion includes three legs evenly spaced apart.

6. The sinkable fun toy as claimed in claim 5, wherein one of the three legs are respectively formed adjacent to each of the first, second and third outer wall of the buffering portion and symmetrically extend from opposite edges of the first, second and third outer walls a predetermined length.

7. The sinkable fun toy as claimed in claim 6, wherein the first engaging portion Includes three protrusions respectively formed on an interior of the first, second and third receiving walls of the receiving portion opposite one of the three legs.

8. The sinkable fun toy as claimed in claim 7, wherein each protrusion has upper and lower guiding surfaces for guiding the protrusion to engaging with the second engaging portion.

9. The sinkable fun toy as claimed in claim 8, wherein the second engaging portion includes a recess located in a peripheral surface of the counterweight member, and opposite side surfaces of the recess are one of arcuate and slanting for facilitating engagement with the three protrusions of the first engaging portion.

10. The sinkable fun toy as claimed in claim 9, wherein the floater body further includes a ring connected to the three legs of the stand portion and the outer wall of the buffering portion.

11. The sinkable fun toy as claimed in claim 4, wherein the counter weight member has a symmetrical shape corresponding to the shape of the receiving opening.

12. The sinkable fun toy as claimed in claim 1, wherein the counter weight member is made of a material selected from a group consisting of a solid hard material and a hollow hard plastic containing a fill material with a specific gravity larger than a specific gravity of water.

13. The sinkable fun toy as claimed in claim 1, wherein the floater body is made from a floatable material selected from floatable plastic, stick foam-cotton and a ballonet.

14. The sinkable fun toy as claimed in claim 1, wherein the receiving opening is large enough to receive a hand.

* * * * *